US006422129B1

(12) United States Patent
Yokomachi et al.

(10) Patent No.: US 6,422,129 B1
(45) Date of Patent: Jul. 23, 2002

(54) SWASH PLATE TYPE REFRIGERANT COMPRESSOR

(75) Inventors: Naoya Yokomachi; Tatsuya Koide; Yoshiyuki Nakane, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/291,419

(22) Filed: Apr. 13, 1999

(30) Foreign Application Priority Data

Apr. 17, 1998 (JP) ..... 10-107532

(51) Int. Cl.[7] ..... F01B 31/10

(52) U.S. Cl. ..... 92/153; 92/12.2; 92/57; 92/71; 417/269

(58) Field of Search ..... 60/487; 92/12.2, 92/51, 71, 153; 417/269

(56) References Cited

U.S. PATENT DOCUMENTS

| | | | | |
|---|---|---|---|---|
| 4,351,227 A | | 9/1982 | Copp, Jr. et al. | 92/71 |
| 4,519,119 A | | 5/1985 | Nakayama et al. | 29/156.5 R |
| 5,857,839 A | * | 1/1999 | Fisher et al. | 417/269 |
| 5,897,298 A | * | 4/1999 | Umemura | 417/269 X |
| 5,921,756 A | * | 7/1999 | Matsuda et al. | 417/269 |
| 6,056,514 A | * | 5/2000 | Fukai | 417/269 X |
| 6,095,761 A | * | 8/2000 | Kanai et al. | 417/269 |
| 6,129,532 A | * | 10/2000 | Kato et al. | 417/269 X |

FOREIGN PATENT DOCUMENTS

| | | |
|---|---|---|
| EP | 0 740 076 A | 10/1996 |
| EP | 0 818 625 A2 | 1/1998 |
| EP | 0 844 389 A1 | 5/1998 |
| JP | 55-35339 | 3/1980 |
| JP | 10-153170 | 6/1998 |

OTHER PUBLICATIONS

EP 99 10 6300 Search Report dated May 24, 2000.

* cited by examiner

*Primary Examiner*—Hoang Nguyen
(74) *Attorney, Agent, or Firm*—Woodcock Washburn LLP

(57) ABSTRACT

A piston-operated compressor, of swash plate type and using $CO_2$ as a refrigerant, having a casing member in which a cylinder bore is formed to have a cylindrical peripheral wall surface and a piston reciprocating for compression in the cylinder bore and being formed of an aluminum alloy. The outer peripheral surface of the piston is coated with a film of a fluororesin material, and a piston ring of an iron metal is fitted in the neighborhood of the top portion of the piston to permit the $CO_2$ refrigerant to be compressed under high pressure. A first oil groove is formed in peripheral direction in parallel to and below the vicinity of the groove at the top portion of the piston in which the piston ring is fitted, and a second oil groove is formed below the first oil groove extending along the axial direction in parallel with the central axis of the piston.

10 Claims, 3 Drawing Sheets

SWASH PLATE TYPE REFRIGERANT COMPRESSOR

BACKGROUND OF THE INVENTION

1. Field of the Invention

The present invention relates to a swash plate type refrigerant compressor using $CO_2$ as a refrigerant. More particularly, the present invention relates to a swash plate type piston-operated refrigerant compressor incorporating therein pistons reciprocating to compress the refrigerant and having an improved sliding performance and an extended operating life.

2. Description of the Related Art

Generally, a single-headed piston operated swash plate type compressor used for a vehicle climate control system includes a swash plate or a cam plate mounted on the drive shaft in a crank chamber, so that the rotation of the swash plate cooperating with the drive shaft is converted into the linear motion of the pistons inserted in cylinder bores. With the reciprocation of the pistons, the refrigerant gas returning from an external refrigeration system is sucked into the cylinder bores from a suction chamber and, after being compressed, is discharged into a discharge chamber. Specifically, many single-headed swash plate type compressors are so configured that the refrigerant returned gas is introduced directly into the cylinder bores without passing through the crank chamber as described above. The lubrication of the sliding portions and elements arranged in the crank chamber, therefore, are primarily dependent on the lubricant supplied to the crank chamber together with the blow-by gas.

The amount of the blow-by gas depends on the size of the fitting gap between the cylinder bores and the pistons. For supplying enough lubricant to properly lubricate the sliding portions and elements in the crank chamber, the fitting gap is required to have an appreciable size. In such a case, the problem of reduced compression efficiency is posed.

The practical application of $CO_2$ as a replacement refrigerant has recently been favored for environmental protection. Nevertheless, with a compressor using $CO_2$ (carbon dioxide gas) as a refrigerant, it is difficult to satisfy the pressure requirements. In a compressor employing an ordinary simple seal method with the cylinder bores and the pistons snugly fitted with each other without using any special sealing means between them, the amount of blow-by gas extremely increases to deteriorate the compressing performance. In view of this, a piston ring, which has thus far attracted little attention for application to an air-conditioning compressor, has recently become important.

Even when the piston ring is used, however, the large difference of the pressure acting on the operating end and the rear end of each piston at the time of compression and the high density of the refrigerant gas increases the gas flow rate, in the same passage area, considerably over the conventional compressor using the fluorinated hydrocarbon gas.

When the pistons move from the bottom dead center toward the top dead center for compressing the refrigerant gas, the compression reaction force and the inertia force of the pistons act on the swash plate, and the force thus acting on the swash plate is exerted on the pistons as a reaction force. In view of the fact that the swash plate is inclined with respect to a plane perpendicular to the center axis of the drive shaft, part of the force acting on the pistons is exerted in such a direction as to press the pistons against the inner periphery of the cylinder bores. Namely, the respective pistons receive side forces from the inner peripheral surface of the corresponding cylinder bores. Especially in the case of the $CO_2$ refrigerant, the side force is so great that the pistons unavoidably come into direct contact with the cylinder bores even if piston rings are fitted on the pistons.

SUMMARY OF THE INVENTION

Accordingly, an object of the present invention is to provide a swash plate type piston-operated refrigerant compressor using the $CO_2$ refrigerant in which the blow-by gas amount is limited in cooperation with the piston ring mounted on the pistons while at the same time preventing direct contact between the cylinder bores and the pistons made of metals of the same type.

Another object of the invention is to provide a swash plate type refrigerant compressor in which superior lubrication of the piston sliding portion is secured and a sufficient amount of lubricant can be supplied to the sliding elements and portions including the swash plate, the shoes, the hinge mechanism and the bearings in the crank chamber.

In accordance with the present invention, there is provided a swash plate type refrigerant compressor which comprises:

at least a casing having at least a cylinder bore and a crank chamber;

a drive shaft supported rotatably on the casing;

a swash plate mounted around the drive shaft to be rotated simultaneously with the drive shaft in the crank chamber; and at least a piston having a top portion inserted into the cylinder bore for compression operation;

wherein the piston operatively engaged with the swash plate acts in the cylinder bore to compress the $CO_2$ refrigerant in response to the rotation of the drive shaft;

wherein a peripheral wall extending around the cylinder bore and the piston is formed of an aluminum alloy as a base metal; and wherein the piston has a central axis and an outer peripheral surface, formed around the central axis, coated with a film of fluororesin material, the piston being provided with a piston ring mounted at a position adjacent to the top portion of the piston.

In the described compressor, the blow-by gas amount is determined by the width of the closed gap of the piston ring and the fitting gap between the cylinder bores and the pistons. Since the fluororesin film is formed on the outer peripheral surface of the pistons, however, direct contact is surely avoided between the metals, of the same type, of the cylinder bores and the pistons. Thus, the fitting gap is minimized so that the blow-by gas amount, i.e. the leakage amount of the compressed refrigerant is reduced to prevent the reduced performance of the compressor. At the same time, the surface contact through the fluororesin film can sufficiently resist a large side force.

Preferably, the casing having the cylinder bores is formed of a hypereutectic aluminum-silicon alloy and the piston ring is made of an iron metal.

The use of a hyper eutectic aluminum-silicon alloy for the casing as described above makes it possible to sufficiently resist the sliding with the piston ring made of an iron metal.

Also, preferably, in a compressor having a first oil groove extending in the peripheral direction in parallel and below a piston ring groove in which the piston ring is mounted, and a second oil groove extending along an axial direction below the first oil groove, the lubricant passage area can be increased for a lower viscous resistance without increasing the gas flow rate. Therefore, the lubricant can be held in the fitting boundary with the cylinder bores.

Further, assume that the second oil groove is formed in such a position as to be partly exposed to the interior of the crank chamber at least when the pistons reach the bottom dead center. Even when the refrigerant compressor is of variable displacement type with an extremely small angle of inclination of the swash plate, the lubricant is positively supplied into the crank chamber from the second oil groove, and therefore superior lubrication is achieved. Furthermore, in the case where the second oil groove is formed on the outer peripheral surface of the pistons where the effect of the side force can be avoided as far as possible, the second oil groove is not strongly pressed against the cylinder bores. Therefore, the wear and damage to both the pistons and the cylinder bores can be prevented.

BRIEF DESCRIPTION OF THE DRAWINGS

The above and other objects, features and advantages will be made more apparent from the detailed description taken in conjunction with the accompanying drawings, wherein.

DESCRIPTION OF THE PREFERRED EMBODIMENTS

Figure 1:
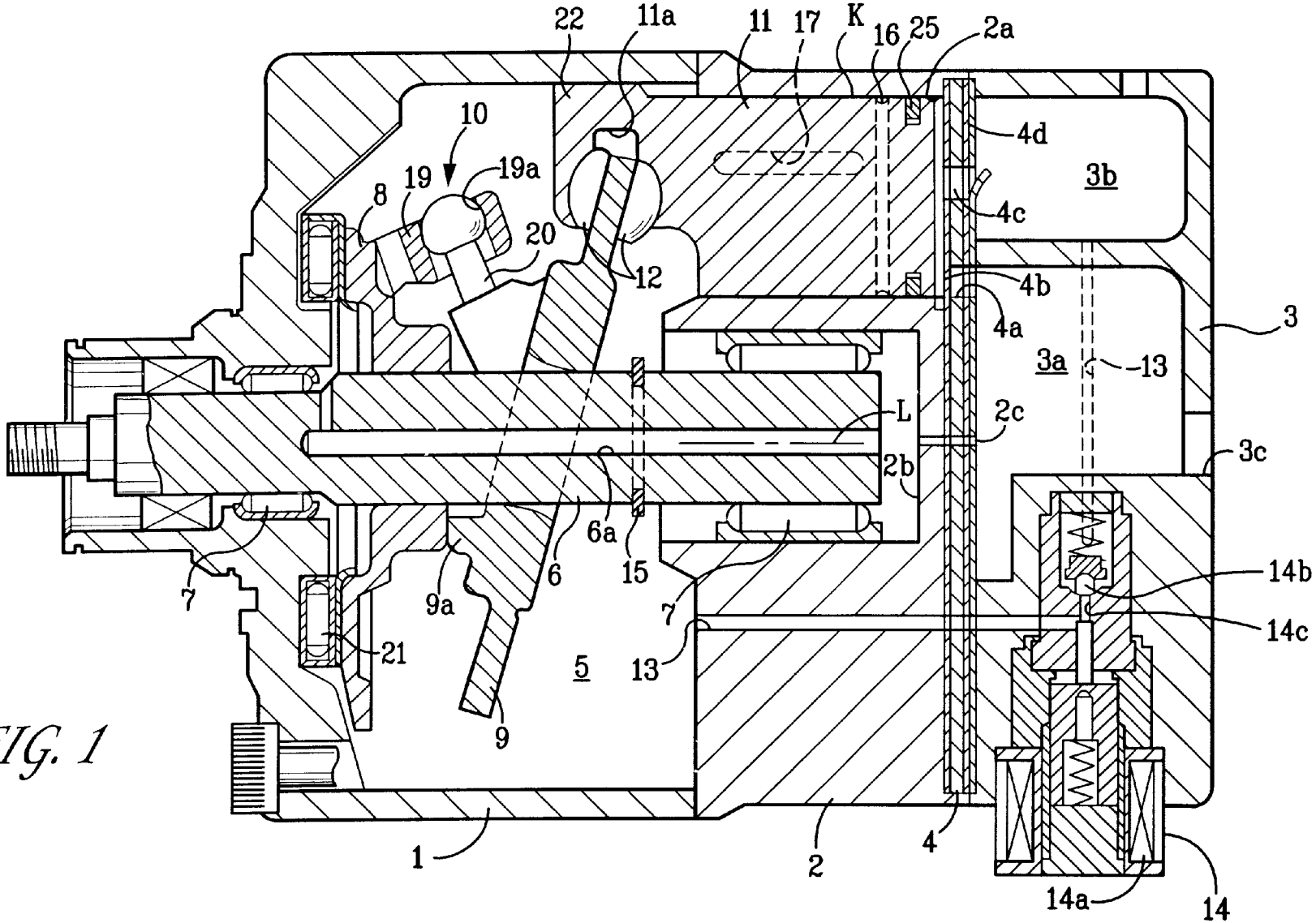
FIG. 1 is a longitudinal cross-sectional view of a swash plate type refrigerant compressor according to an embodiment of the present invention.

Referring to FIG. 1, a front housing 1 is coupled to the front end surface of a cylinder block 2. A rear housing 3 is coupled to the rear end surface of the cylinder block 2 through a valve plate 4. The front housing 1, the cylinder block 2 and the rear housing 3 constitute members of a compressor casing. A suction chamber 3*a* and a discharge chamber 3*b* are formed between the rear housing 3 and the valve plate 4. The refrigerant gas ($CO_2$) from an external refrigeration circuit (not shown) is introduced directly into the suction chamber 3*a* through an inlet port 3*c*.

The valve plate 4 includes suction ports 4*a*, a suction valve 4*b*, a discharge port 4*c* and a discharge valve 4*d*. A crank chamber 5 is formed between the front housing 1 and the cylinder block 2. A drive shaft 6 is rotatably supported on the front housing 1 and the cylinder block 2 through a pair of bearings 7 and arranged through the crank chamber 5. A support hole 2*b* is formed at the central portion of the cylinder block 2. The rear end of the drive shaft 6 is inserted into the support hole 2*b*, and the rear end thereof is supported on the inner peripheral surface of the support hole 2*b* through the bearings 7.

A lug plate 8 is fixed on the drive shaft 6. A swash plate 9 is supported on the drive shaft 6 slidably and movably in the direction along the axis L thereof in the crank chamber 5. The swash plate 9 is coupled to the lug plate 8 through a hinge mechanism 10. The hinge mechanism 10 includes a support arm 19 formed on the lug plate 8 and a pair of guide pins 20 formed on the swash plate 9. The guide pins 20 are slidably inserted into a pair of guide holes 19*a*, respectively, formed in the support arm 19. The hinge mechanism 10 is adapted to rotate the swash plate 9 integrally with the drive shaft 6. Further, the hinge mechanism 10 guides the swash plate 9 to move in the direction along the axis L and to be inclined.

A plurality of cylinder bores 2*a* are formed in the cylinder block 2 around the drive shaft 6 and extend in the direction along the axis L. A single-headed piston 11 is housed in the cylinder bores 2*a*. The tail of the piston 11 is formed with a groove 11*a*. The hemispherical portions of a pair of shoes 12 are fitted relatively movably within the opposed inner wall surfaces of the groove 11*a*. The swash plate 9 is held slidably between the flat portions of the shoes 12. The rotational motion of the swash plate 9 is converted into the reciprocal linear motion of the piston 11 through the shoes 12, so that the piston 11 longitudinally reciprocates in the cylinder bores 2*a*. In a suction stroke, when the piston 11 moves from its top dead center toward its bottom dead center, the refrigerant gas in the suction chamber 3*a* pushes a suction valve 4*b* from a suction port 4*a* to open the latter and flows into the cylinder bores 2*a*. In a compression stroke, when the piston 11 moves from the bottom dead center to the top dead center, on the other hand, the refrigerant gas in the cylinder bores 2*a* is compressed, pushes a discharge valve 4*d* from a discharge port 4*c* to open the port 4*c* and is discharged into a discharge chamber 3*b*.

A thrust bearing 21 is arranged between the lug plate 8 and the inner surface of the front housing 1. With the compression of the refrigerant gas, the compression reaction force is exerted on the piston 11, This compression reaction force is received by the front housing 1 through the piston 11, the swash plate 9, the lug plate 8 and the thrust bearing 21.

Figure 2:
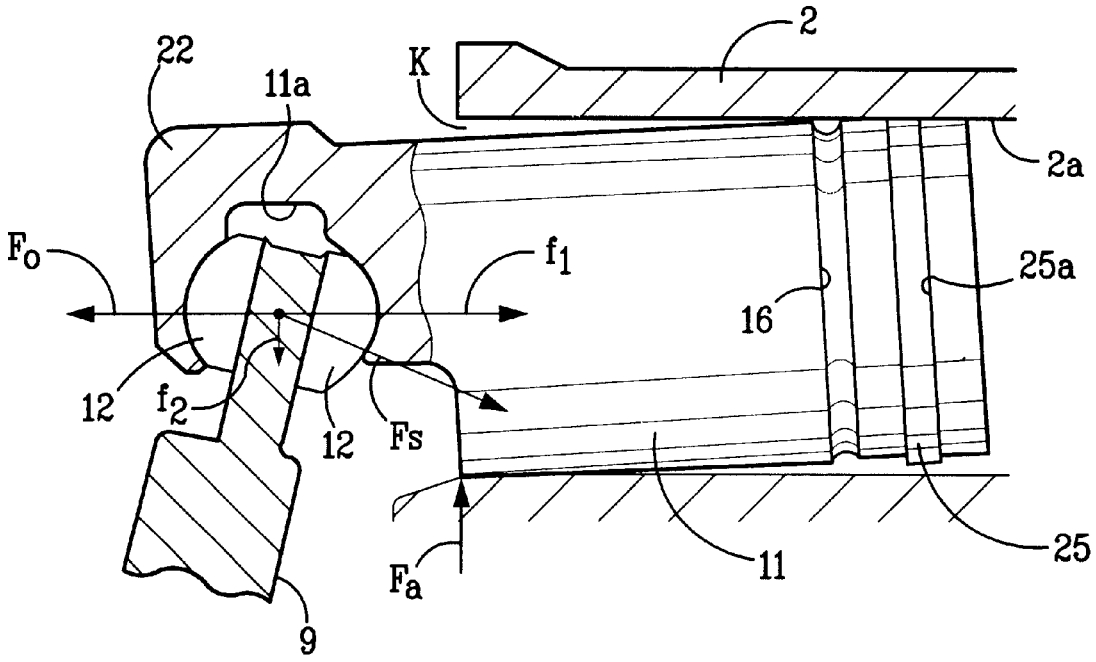
FIG. 2 is an enlarged sectional view of an essential portion of the compressor of FIG. 1, illustrating, with exaggeration, the piston tilted at the top dead center.
Figure 3:
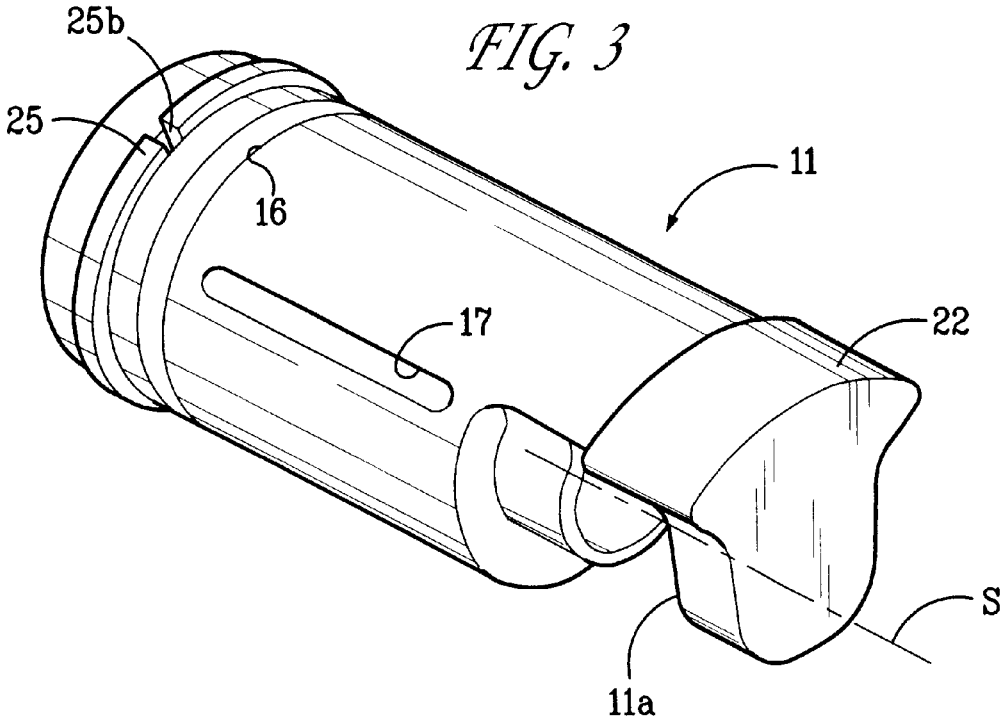
FIG. 3 is a perspective view of the piston according to an embodiment of the present invention.

As shown in FIGS. 1 to 3, the piston 11 is formed integrally with a stopper 22. The stopper 22 has a peripheral surface of substantially the same diameter as the inner peripheral surface of the front housing 1. The peripheral surface of the stopper 22 is in contact with the inner peripheral surface of the front housing 1 in order to prevent the rotation of the piston 11 about the center axis S.

As shown in FIG. 1, the compressor has a gas supply passage 13 fluidly connecting the discharge chamber 3*b* and the crank chamber 5. Specifically, an end of the gas supply passage 13 is open to the crank chamber 5, and the other end thereof is connected to an electromagnetic valve 14 mounted on the rear housing 3. The gas supply passage 13 extends from the electromagnetic valve 14 to the discharge chamber 3*b*. In other words, the electromagnetic valve 14 is arranged midway in the gas supply passage 13.

The electromagnetic valve or solenoid valve 14 has a solenoid 14*a*. Upon energization of the solenoid 14*a*, a valve body 14*b* closes a valve hole 14*c*. When the solenoid 14*a* is deenergized, on the other hand, the valve body 14*b* opens the valve hole 14*c*.

A gas withdrawal passage 6*a* is formed in the drive shaft 6. The gas withdrawal passage 6*a* has an inlet open to the crank chamber 5, forward of the drive shaft 6*a*, and an outlet open into the support hole 2*b*, rearward of the drive shaft 6*a*. A gas withdrawal hole 2*c* is connected to the interior of the support hole 2*b* and the suction chamber 3*a*. When the gas supply passage 13 is closed at the position of the valve hole 14*c* with the solenoid 14*a* energized, the high-pressure refrigerant gas in the discharge chamber 3*b* is not supplied to the crank chamber. Under this condition, the refrigerant gas in the crank chamber 5 only flows out into the suction chamber 3*a* through the gas supply passage 6*a* and the gas withdrawal hole 2*c,* so that the internal pressure of the crank chamber 5 approaches the low internal pressure of the suction chamber 3*a.* As a result, the difference is reduced between the internal pressure of the crank chamber 5 and the internal pressure of the cylinder bores 2*a,* and as shown in FIG. 1, the inclination angle of the swash plate 9 (the angle of inclination from a plane perpendicular to the axis of rotational of the drive shaft 6) becomes maximum, thereby maximizing the discharge capacity of the compressor.

AS long as the valve hole 14*c* is open with the solenoid 14*a* deenergized, the high-pressure refrigerant gas in the discharge chamber 3*b* is supplied through the gas supply passage 13 to the crank chamber 5 so that the internal pressure in the crank chamber 5 increases. As a result, the difference increases between the internal pressure of the crank chamber 5 and the internal pressure of the cylinder bores 2*a,* until finally the inclination angle of the swash plate 9 reaches a minimum thereby to minimize the discharge capacity of the compressor.

The swash plate 9 has a stop protrusion 9*a* formed on the front side thereof, which is brought into contact with the lug plate 8 and thus the swash plate is restricted to not exceed a predetermined maximum inclination angle. The swash plate 9 is also restricted to a minimum inclination angle by being brought into contact with a ring 15 mounted on the rear portion of the drive shaft 6.

As described above, the intermediate portion of the gas supply passage 13 is closed and opened in response to the energization and deenergization of the solenoid 14*a* of the solenoid valve 14. Thus, the internal pressure of the crank chamber 5 is regulated. With a change in the internal pressure of the crank chamber 5, the difference also changes between the internal pressure of the crank chamber 5 exerted on the front surface (the left side in FIG. 1) of the piston 11 and the internal pressure of the cylinder bores 2*a* exerted on the rear surface (the right side subjected to compression in FIG. 1) of the piston 11. Thus, the inclination angle of the swash plate 9 coupled to the piston 11 through the shoes 12 also undergoes a change. The change in the angle of inclination of the swash plate 9 causes a change in the stroke amount of the piston 11 to thereby regulate the discharge capacity of the compressor. The solenoid 14*a* of the electromagnetic valve 14 is energized or deenergized selectively in accordance with the information such as the cooling load under the control of a controller (not shown). In other words, the discharge capacity of the compressor is regulated in accordance with the cooling load.

As a feature of the present invention, the cylinder block 2 having the cylinder bores 2*a* and the piston 11 are fabricated of an aluminum alloy, or preferably a hyper eutectic aluminum-silicon alloy. In the neighborhood of the apex of the outer peripheral surface of the piston 11, an annular groove 25*a* is formed, into which the piston ring 25 is fitted. A fluororesin (polytetrafluoroethylene) film is formed on the outer peripheral surface of the piston 11 for avoiding direct contact with a metal of the same type and minimizing the fitting gap K with the cylinder bores 2*a.*

Further, each piston 11 is formed with a later-described oil groove for holding the lubricant against the corresponding cylinder bores 2*a* and assuring a positive oil supply into the crank chamber 5.

More specifically, as shown in FIG. 3, a first oil groove 16 is formed extending along the peripheral direction in parallel to and in the area below the annular groove 25*a* formed in the outer peripheral surface of the piston 11. According to this embodiment, the first oil groove 16 is formed in annular fashion around the whole periphery of the piston 11. The first oil groove 16 is not exposed into the crank chamber 5 from inside the cylinder bores 2*a* when the piston 11 moves to the bottom dead center thereof.

The piston 11 is further formed with a second oil groove 17. Specifically, the second oil groove 17 is formed extending from the area further below the first oil groove 16 along the center axis S of the piston 11. The second oil groove 17 is provided and configured as described hereinbelow.

Figure 4A:
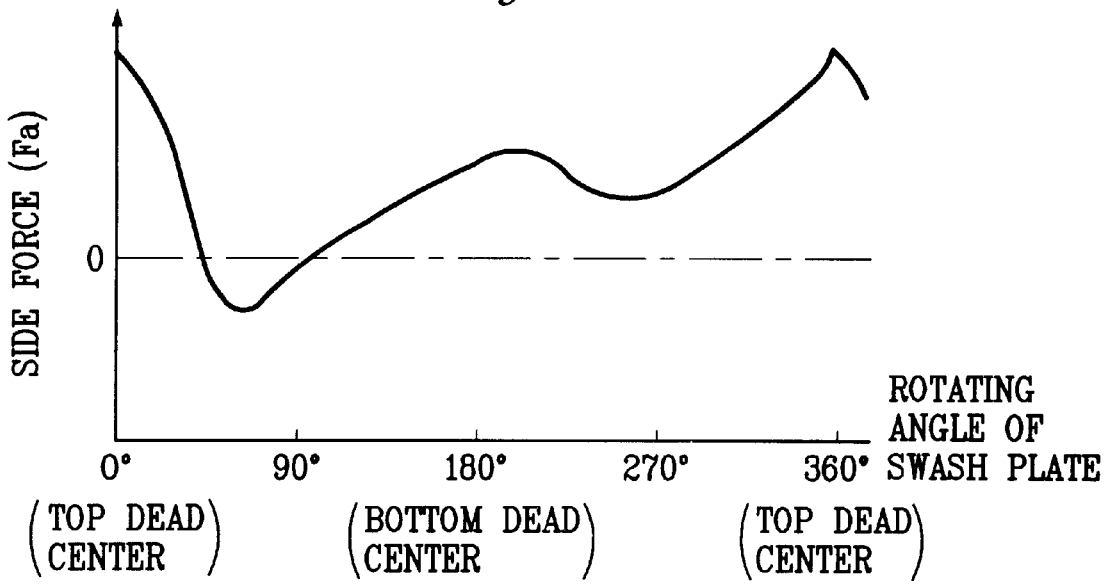
FIG. 4A is a graphical view showing the relation between the rotational angle of the swash plate plotted along the abscissa and the magnitude of the side force acting on each piston plotted along the ordinate.
Figure 4B:
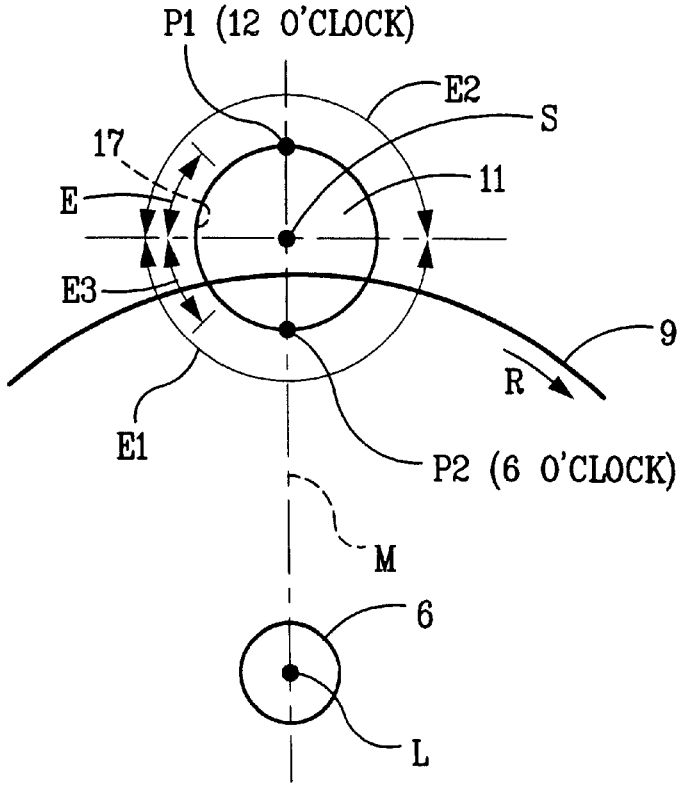
FIG. 4B is a diagrammatic view to explain the phase around the piston provided with a second oil groove formed therein.

As shown in FIG. 4B, suppose a straight line M is drawn extending through the center axis L of the drive shaft 6 and the center axis S of the piston 11 when the piston 11 is viewed from the side thereof where the rotational direction R of the drive shaft 6 indicated by the arrow is clockwise (when the piston 11 is viewed from the tail thereof in FIG. 4B). Of the intersections P1, P2. between the straight line M and the peripheral surface of the piston 11, the intersection P1 far from the center axis L of the drive shaft 6 is assumed to be the 12 o'clock position. In this case, the second oil groove 17 is formed in the range E of the 9 o'clock position to the 10:30 position on the peripheral surface of the piston 11. Further, the second oil groove 17 is formed at such a position and with such a length as not to be exposed to the interior of the crank chamber 5 when the piston 11 moves to the vicinity of the top dead center.

In the compressor described above, when the piston 11 moves from top dead center to bottom dead center in suction stroke, the refrigerant gas in the suction chamber 3*a* is sucked into the cylinder bores 2*a.* In the process, part of the lubricant contained in the refrigerant gas attaches to the inner peripheral surface of the cylinder bores 2*a.* In the compression stroke when the piston 11 moves from the bottom dead center to the top dead center, on the other hand, the refrigerant gas in the cylinder bores 2*a* is compressed and discharged into the discharge chamber 3*b.* At the same time, part of the refrigerant gas that has passed through the closed gap of the piston ring 25 leaks into the crank chamber 5 as a blow-by gas through the limited fitting gap K between the outer peripheral surface of the piston 11 and the inner peripheral surface of the cylinder bores 2*a.*

The lubricant that has entered the fitting gap K together with the blow-by gas, on the other hand, is trapped and stored in the first oil groove 16 with the movement of the piston 11. When the piston 11 is in a compression stroke, the internal pressure of the oil groove 16 increases due to the blow-by gas in the fitting gap K. The second oil groove 17, however, is exposed at least partially in the crank chamber 5 in other than the case where the piston 11 moves to the vicinity of the top dead center. The internal pressure of the second oil groove 17, therefore, is equal to or only slightly higher than the internal pressure of the crank chamber 5. Thus, the differential pressure between the oil grooves 16, 17 in spaced opposed relation to each other through the fitting gap K causes the lubricant in the first oil groove 16 to flow into the second oil groove 17. In the process, unlike the refrigerant gas constituting a compressive fluid, the viscous resistance of the oil component high in viscosity is affected by the length. In view of this, the length is reduced by forming the second oil groove 17, while at the same time enlarging the area of the lubricant passage in the long seal portion thereby to attenuate the viscous resistance. In this way, a smooth sliding motion is secured in the fitting boundary with the cylinder bores 2*a*. Also, the lubricant in the second oil groove 17 is supplied, through the groove portion exposed in the crank chamber 5, to the sliding portions in the crank chamber 5, i.e. the relative sliding portions of the swash plate 9, the shoes 2 and the piston 11, thereby to lubricate those portions sufficiently.

The reaction force (hereinafter referred to as the side force) is exerted on the piston 11, while in reciprocal motion, from the inner peripheral surface of the cylinder bores 2*a* due to the compression reaction force and its own inertia. As a result, the second oil groove 17 is preferably formed at a position on the peripheral surface of the piston 11 as free of the effect of the side force as possible.

More specifically, as shown in FIG. 2, when the piston 11 is in the vicinity of top dead center, the compression reaction force exerted on the piston 11 reaches a maximum. This compression reaction force and the force of inertia of the piston 11 act on the swash plate 9. Therefore, the piston 11 is subjected to a large reaction force Fs corresponding to the resultant force of the compression reaction force and the force of inertia from the swash plate 9 tilted with respect to the plane perpendicular to the center axis L of the drive shaft 6. This reaction force Fs can be decomposed into a component force F1 along the direction of movement of the piston 11 and a component force $f_2$ along the center axis L of the drive shaft 6. The component force $f_2$ causes the tail of the piston 11 to tilt toward the component force $f_2$. For this reason, the peripheral surface of the tail of the piston 11 is pressed against the inner peripheral surface in the vicinity of the opening of the cylinder bores 2*a* with a force corresponding to the component force $f_2$. In other words, the peripheral surface of the tail of the piston 11 is subjected to a large reaction force (side force) Fa corresponding to the component force $f_2$ from the inner peripheral surface in the vicinity of the opening of the cylinder bores 2*a*.

The position at which the side force Fa acts on the piston 11 changes with the reciprocal motion of the piston 11. During the period from the time point when the piston 11 is located at the top dead center to the time point when the swash plate rotates by 90° in the direction of arrow R, for example, the compressed refrigerant gas staying in the cylinder bores 2*a* is expanded again with the movement of the piston 11 from top dead center to bottom dead center. After the end of the reexpansion, the refrigerant gas starts to be sucked into the cylinder bores 2*a*. In the process, the compression reaction force is not exerted on the swash plate 9, and the force $F_0$ acting on the swash plate 9 is substantially equal to the force of inertia of the piston 11. Thus, the piston 11 is subjected to the reaction force Fs mainly based on the force of inertia from the swash plate 9. This reaction force Fs can be decomposed into a component force $f_1$ along the direction of movement of the piston 11 and a component force $f_2$ substantially along the rotational direction R of the swash plate 9, in accordance with the inclination angle of the swash plate 9. The component force $f_2$ causes the tail of the piston 11 to tilt in the direction of the component force $f_2$. As a result, the piston 11 is subjected to the side force Fa corresponding to the component force $f_2$ from the inner peripheral surface in the vicinity of the opening of the cylinder bores 2*a*. Actually, however, under this condition, the force $F_0$acting on the swash plate 9 becomes substantially zero. Therefore, the side force Fa is not substantially exerted on the piston 11.

When the swash plate 9 rotates by 90° in the direction of the arrow R and the piston 11 comes to the bottom dead center thereof, the direction of the component force $f_2$ exerted on the piston 11 is reversed from the case of FIG. 2 (where the piston 11 is located at top dead center). Thus, the piston 11 is subjected to the side force Fa in the reverse direction to the case of FIG. 2 from the inner surface in the vicinity of the opening of the cylinder bores 2*a*. In the process, the magnitude of the side force Fa is smaller than in the case of FIG. 2.

FIG. 4A is a graph showing the relation between the rotational angle of the swash plate 9 (the coverage of the piston 11) and the magnitude of the side force Fa acting on the piston 11. In this graph, the rotational angle of the swash pate 9 when the piston 11 is at top dead center is assumed to be 0°.

As shown in FIG. 4A, during the period from the time point when the piston 11 is located at top dead center to the time point when the swash plate 9 rotates by 90°, the side force Fa may assume a negative value. This indicates that the direction of each force described above becomes reversed.

The graph of FIG. 4A indicates that when the rotational angle of the swash plate 9 is 0°, i.e. when the piston 11 is at top dead center, the side force Fa acting on the piston 11 becomes a maximum. The position on the peripheral surface of the piston 11 where the maximum side force Fa is exerted is the 6 o'clock position as shown in FIG. 4B. When a large side force Fa is exerted at the 6 o'clock position on the peripheral surface of the piston 11, the range E1 of 3 o'clock to 9 o'clock positions with the 6 o'clock position at the center thereof is where the piston 11 is pressed, strongly against the inner peripheral surface of the cylinder bore 2*a*. In the case where a second oil groove 17 is formed in the range E1, therefore, the opening edge of the second oil groove 17 is strongly pressed against the inner peripheral surface of the cylinder bores 2*a,* thereby sometimes wearing or damaging the piston 11 or the cylinder bores 2*a*. Preferably, therefore, the second oil groove 17 is formed in the range other than the range E1 of 3 o'clock to 9 o'clock positions, i.e. in the range E2 of 9 o'clock to 3 o'clock positions on the peripheral surface of the piston 11.

To avoid the effect of the side force Fa, the second oil groove 17 is preferably formed in the part of the range E2 of 9 o'clock to 3 o'clock where the side force Fa exerted on the peripheral surface of the piston 11 is minimum. The graph of FIG. 4A indicates that the side force Fa acting on the piston 11 is smaller when the piston 11 is in suction stroke (when the rotational angle of the swash plate 9 is 0° to 180°) than when the piston 11 in compression stroke (when the rotational angle of the swash plate 9 is 180° to 360°).

At the end of the reexpansion of the residual refrigerant gas in the cylinder bores 2*a* in a suction stroke, no compression reaction force is exerted on the swash plate 9 but most of the force exerted on the swash plate 9 is the force of inertia of the piston 11. Particularly, when the rotational angle of the swash plate 9 is 90° as shown in FIG. 4A, substantially no side force Fa acts on the peripheral surface of the piston 11 at the 9 o'clock position on the peripheral surface of the piston 11. The side force Fa acting on the piston 11, therefore, is smaller in suction stroke than in compression stroke when the compression reaction force occurs. In other words, in the range E2 of 9 o'clock to 3 o'clock on the peripheral surface of the piston 11, the side force Fa exerted in the range of 9 o'clock to 12 o'clock is smaller than that exerted in the range of 12 o'clock to 3 o'clock.

In addition, as shown in FIG. 4A, when the piston 11 is located at the bottom dead center, a comparatively large side force Fa acts at the 12 o'clock position on the peripheral surface of the piston 11. The piston 11, when moved to the neighborhood of bottom dead center, may become unstable as the length supported by the cylinder bores 2*a* becomes shorter. Therefore, the second oil groove 17 is preferably not formed in the neighborhood of the 12 o'clock position on the peripheral surface of the piston 11.

Taking the foregoing facts into consideration, according to this embodiment, as shown in FIG. 4B, the second oil groove 17 is formed in the range E of 9 o'clock to 10:30 on the peripheral surface of the piston 11.

It will be understood from the foregoing description that, in the swash plate type compressor according to the present invention, the peripheral wall of the cylinder bores and the piston are fabricated of an aluminum alloy, direct contact between metals of the same type is avoided by the fluororesin film formed on the outer peripheral surface of the piston, and the fitting gap with the cylinder bores is minimized. As a result, coupled with the use of a piston ring, the amount of the blow-by gas can be limited to minimum. Thus, the $CO_2$ gas can be employed as a refrigerant gas without reducing the compression performance.

Also, in the swash plate type compressor according to this invention, when the first and second oil grooves are formed in the outer peripheral surface of the piston, the viscous resistance of the oil component can be reduced to secure a smooth sliding motion of the piston without increasing the gas flow rate through the fitting gap with the cylinder bores. Further, a sufficient amount of oil can be supplied to the sliding portions in the crank chamber through these oil grooves.

Furthermore, in the case where the second oil groove is formed in a phase minimizing the effect of the side force on the outer peripheral surface of the piston, the second oil groove can be sufficiently protected from wear and damage and the side force can be positively supported by the fluororesin film.

What is claimed is:

1. A swash plate type compressor comprising:

a casing having at least a cylinder bore and a crank chamber;

a drive shaft supported rotatably on said casing;

a swash plate mounted around said drive shaft to be rotated simultaneously with said drive shaft in said crank chamber; and a piston having a top portion inserted into said cylinder bore for compression operation;

wherein said piston operatively engages with said swash plate acts in said cylinder bore to compress a $CO_2$ refrigerant in response to the rotation of said drive shaft;

wherein a peripheral wall extending around said cylinder bore and said piston are formed of an aluminum alloy as a base material; and wherein said piston has a central axis and an outer peripheral surface formed around said central axis coated with a film of fluororesin material, said piston being provided with a piston ring mounted at a position adjacent to said top portion of said piston, and said piston outer peripheral surface being provided with a first oil groove formed therein to extend in the peripheral direction in parallel to and below an annular groove into which said piston ring is fitted, and a second oil groove formed below said first oil groove to extend in a direction parallel with the center axis of said piston.

2. A compressor according to claim 1, wherein said casing member having said cylinder bore is made of a hypereutectic aluminum-silicon alloy.

3. A compressor according to claim 1, wherein said piston ring is made of an iron metal.

4. A compressor according to claim 1, wherein said second oil groove is formed in such a manner as to be partly exposed in the crank chamber when said piston reaches at least the bottom dead center in said cylinder bore.

5. A compressor according to claim 1, wherein said second oil groove is formed in said outer peripheral surface of said piston at a predetermined area thereof capable of minimizing the effect of a side force acting on said piston during the compression operation of the compressor.

6. A compressor according to claim 1, wherein said piston has an end portion thereof far from said top portion along the axial direction and is operatively engaged with said swash plate at said end portion via shoes, said end portion having a piston stopper.

7. A compressor according to claim 6, wherein said end portion of said piston is formed in such a manner as to be located in said crank chamber even when said piston is at the top dead center thereof.

8. A compressor according to claim 6, wherein said outer peripheral surface of said piston is formed with a first oil groove extending along the peripheral direction in parallel to and below an annular groove into which said piston ring is fitted, and a second oil groove extending along said central axis from under said first oil groove toward said piston end portion and having a part thereof adapted to be exposed in the crank chamber when said piston reaches at least the bottom dead center thereof in said cylinder bore.

9. A compressor according to claim 8, wherein said compressor is a variable capacity swash type compressor.

10. A compressor according to claim 8, wherein, assuming that the upper and lower positions at which the straight lines connecting the center of said drive shaft and the axial centers of said pistons intersect with the outer peripheral surface of said pistons are the 12 o'clock position and the 6 o'clock position, respectively, and also assuming that the 3 o'clock position and the 9 o'clock position are located between said 12 o'clock position and said 6 o'clock position on the particular outer peripheral surface, said second oil groove is formed in the area at least from the 9 o'clock position to the 3 o'clock position through the 12 o'clock position on the outer peripheral surface of said piston.

* * * * *